United States Patent [19]

Yasuoka et al.

[11] Patent Number: 4,508,087

[45] Date of Patent: Apr. 2, 1985

[54] METHOD FOR CONTROLLING FUEL SUPPLY TO AN INTERNAL COMBUSTION ENGINE AFTER TERMINATION OF FUEL CUT

[75] Inventors: Akimasa Yasuoka, Tokyo; Yutaka Otobe, Shiki, both of Japan

[73] Assignee: Honda Giken Kogyo Kabushiki Kaisha, Tokyo, Japan

[21] Appl. No.: 506,672

[22] Filed: Jun. 22, 1983

[30] Foreign Application Priority Data

Jun. 23, 1982 [JP] Japan ..... 57-107952

[51] Int. Cl.[3] ..... F02B 3/00

[52] U.S. Cl. ..... 123/493; 123/492; 123/494

[58] Field of Search ..... 123/493, 492, 494, 478, 123/480, 481, 325

[56] References Cited

U.S. PATENT DOCUMENTS

| | | | |
|---|---|---|---|
| 3,727,591 | 4/1973 | Suda | 123/493 |
| 3,916,170 | 10/1975 | Noriusatsu et al. | 123/493 |
| 4,133,326 | 1/1979 | Gops et al. | 123/493 |
| 4,428,349 | 1/1984 | Snow | 123/493 |
| 4,434,769 | 3/1984 | Otobe et al. | 123/493 |
| 4,437,442 | 3/1984 | Tamaguchi | 123/493 |

*Primary Examiner*—Raymond A. Nelli
*Attorney, Agent, or Firm*—Lyon & Lyon

[57] ABSTRACT

A method for controlling the quantity of fuel being supplied to an internal combustion engine, immediately after termination of a fuel cut operation which is carried out when the engine is operating in a predetermined operating region while it is decelerating. The fuel quantity is controlled to a required value after termination of a fuel cut operation, by increasing a quantity of fuel set at least as a function of intake pipe pressure by an increment which is set in synchronism with generation of pulses of a predetermined control signal. The increase of the fuel quantity is effected for a period of time after a transition of the operative state of the engine from the fuel cut operation to a normal operation wherein fuel supply is effected has been detected and before a predetermined number of pulses of the above control signal are generated, so long as the magnitude of a variation or change in the rotational speed of the engine is determined to be larger than a predetermined value. Preferably, the increase of fuel quantity is effected only when the rotational speed of the engine is below a predetermined value of rpm. Further, while the magnitude of a variation in the rotational speed of the engine is smaller than the above predetermined value, the increase of the fuel quantity is prohibited, and instead the fuel quantity is determined as a function of a value of intake pipe pressure which is set by subtracting a value dependent upon the engine rotational speed from a detected value of intake pipe absolute pressure, until all the engine cylinders are supplied with fuel after the transition to the normal operation of the engine has been detected.

6 Claims, 8 Drawing Figures

FIRST PROGRAM
1
SECOND PROGRAM
2
START CONTROL
3
BASIC CONTROL
4
ASYNCHRONOUS CONTROL
5
6,7
TiCRM,TiCRS TABLES
8
KNe TABLE
9
TV TABLE
10
BASIC Ti MAP
11
ACC/DEC SUBROUTINE
12
COEFFICIENT CALCULATING TABLES, SUBROUTINES
9
TV TABLE
13
TiA TABLE
14
KTW TABLE
9
TV TABLE

| FIG. 4A | FIG. 4B |
|---|---|

10
IS FUEL CUT REQUIRED ?
Yes
No
B
12'
16
nAFC ≧ 4 ?
Yes
No
17
Ne<NFCTIL ?
No
Yes
18
nAFC = 8 ?
Yes
No
20
nMPB > 0 ?
No
Yes
21
ΔMen>ΔMeo ?
No
Yes
22
READ OUT KAFC CORRESPONDING TO nAFC
19
KAFC = 1
nTFLG = 1
23
nAFC = nAFC + 1
24
nMPB = nMPB - 1
25
C
11
11a
nAFC = 0
11b
nMPB = 4
11c
TOUTM = 0
TOUTS = 0
15
ACTUATE INJECTORS

METHOD FOR CONTROLLING FUEL SUPPLY TO AN INTERNAL COMBUSTION ENGINE AFTER TERMINATION OF FUEL CUT

BACKGROUND OF THE INVENTION

This invention relates to a fuel supply control method for internal combustion engines, and more particularly to a method of this kind which is adapted to supply the engine with a quantity of fuel optimal to operating conditions of the engine, after termination of a fuel cut action which is effected at deceleration of the engine, thereby improving the emission characteristics, driveability and fuel consumption of the engine.

In conventional methods of controlling the fuel supply to an internal combustion engine in response to operating conditions of the engine, by means of an electronically controlled fuel injection system, it is known to cut off the fuel supply to the engine at deceleration for improvement of the fuel consumption and emission characteristics of the engine, and then increase the fuel quantity being supplied to the engine after termination of the fuel cut operation, so as to improve the driveability of the engine. As such after-fuel cut fuel control methods, it has been proposed by Japanese Utility Model Provisional Publication (Kokai) No. 53-33721 to increase the fuel quantity by setting a longer fuel injection period for a predetermined period of time starting from the termination of a fuel cut operation, and it has also been proposed by Japanese Patent Provisional Publication (Kokai) No. 56-47631 to increase the fuel quantity by an amount corresponding to the duration of the immediately preceding fuel cut operation.

According to the above proposed methods, the increase of the fuel quantity after the termination of a fuel cut operation is based upon the fact that if the clutch is disengaged immediately after the termination of the fuel cut operation, the engine speed suddenly drops to cause engine stall, and to avoid such engine stall, it is neccessary to supply a sufficient amount of fuel to the engine immediately after the termination of a fuel cut operation.

However, if the clutch is kept in its engaged position after the termination of a fuel cut operation, the engine is free from a sudden drop in the rotational speed, and therefore there is no fear of occurrence of engine stall. If nevertheless the fuel quantity is increased on such occasion, the air/fuel ratio will become overrich, resulting in deterioration of the emission characteristics, increased fuel consumption, etc. Besides, after the termination of a fuel cut operation, the air/fuel ratio of the mixture being supplied to the engine is prone to become overrich by the following reason, too. That is, as generally known, the actual intake air quantity supplied to the engine during normal combustion operation is larger than that during non-combustion operation (hereinafter merely called "motoring"), or in other words, the charging efficiency of the engine during normal combustion operation is higher than that during motoring. This means that the intake pipe absolute pressure during motoring of the engine is higher than that during normal combustion operation of same. Therefore, if a fuel supply control method in which the fuel quantity is determined at least in dependence on the intake pipe absolute pressure is applied after the termination of a fuel cut operation, an excessive quantity of fuel is supplied to the engine immediately after a transition from the fuel cut operation or motoring to a normal combustion operation, resulting in increased fuel consumption, deteriorated emission characteristics and degraded driveability of the engine, due to the phenomenon that the intake pipe absolute pressure during fuel cut operation or motoring is higher than that during normal combustion operation.

SUMMARY OF THE INVENTION

It is the object of the invention to provide a fuel supply control method for internal combustion engines, which is adapted to control the quantity of fuel being supplied to the engine after termination of a fuel cut operation, to an appropriate quantity dependent upon the operating condition of the engine on such occasion, thereby preventing engine stall as well as improving the emission characteristics, fuel consumption, etc. of the engine.

According to a first aspect of the invention, there is provided a method for controlling the quantity of fuel being supplied to an internal combustion engine, to a required quantity, by increasing the fuel quantity by an increment which is set in synchronism with generation of pulses of a predetermined control signal generated at a predetermined crank angle of the engine, after the termination of a fuel cut operation which is effected when the engine is operating in a predetermined operating condition while it is decelerating. The method according to the first aspect of the invention is characterized by comprising the following steps: (1) detecting a transition of the operative state of the engine from the above predetermined operating condition wherein the fuel supply to the engine is to be cut off to another operating condition wherein the fuel supply is to be effected; (2) detecting the magnitude of a variation in the rotational speed of the engine and determining whether or not the detected magnitude of variation is larger than a predetermined value; and (3) effecting the above-mentioned increase of the fuel quantity for a period of time after the above transition has been detected and before a predetermined number of pulses of the above control signal are generated, so long as it is determined in the step (2) that the detected magnitude of variation is larger than the above predetermined value.

According to a second aspect of the invention, there is provided a method for controlling the quantity of fuel being supplied to an internal combustion engine equipped with a pressure sensor means for detecting pressure in an intake passage of the engine, to a required quantity, by increasing a quantity of fuel which is set at least in dependence upon the value of an output signal from the above pressure sensor means, by an increment which is set in synchronism with generation of pulses of a predetermined control signal generated at a predetermined crank angle of the engine, after the termination of a fuel cut operation which is effected when the engine is operating in a predetermined operating condition while it is decelerating. The method according to the second aspect of the invention is characterized by comprising the following steps: (1) detecting a transition of the operative state of the engine from the above predetermined operating condition wherein the fuel supply to the engine is to be cut off to another operating condition wherein the fuel supply is to be effected; (2) detecting the magnitude of a variation in the rotational speed of the engine and determining whether or not the detected magnitude of variation is larger than a predetermined value; and (3) controlling the quantity of fuel being supplied to the engine in the below-mentioned manner, for a period of time after the above transition has been detected and before a predetermined number of pulses of the above control signal are generated: (a) effecting the above-mentioned increase of the fuel quantity so long as it is determined in the step (2) that the above detected magnitude of variation is larger than the above predetermined value; and (b) subtracting a predetermined value of intake passage pressure from an actual detected value of intake passage pressure and determining the quantity of fuel being supplied to the engine in dependence on the value of intake passage pressure thus subtracted, for a period of time after the above transition has been detected and before all the cylinders of the engine are supplied with fuel, so long as it is determined in the step (2) that the above detected magnitude of a variation in the rotational speed of the engine is smaller than the above predetermined value.

Preferably, the increase of the fuel quantity according to the first and second aspects of the invention is effected only when the engine speed is lower than a predetermined value of rpm.

Further, preferably, the above predetermined value of intake passage pressure to be subtracted from an actual detected value of intake passage pressure is set to a value corresponding to the difference between a value of intake passage pressure detected during non-combustion operation or motoring of the engine and one detected during normal combustion operation of the engine, provided that the engine speed remains constant between the two operations of the engine. The predetermined value of intake passage pressure is set to larger values as the engine speed becomes higher.

The above and other objects, features and advantages of the invention will be more apparent from the ensuing detailed description taken in connection with the accompanying drawings.

DETAILED DESCRIPTION

The present invention will now be described in detail with reference to the drawings.

Figure 1:
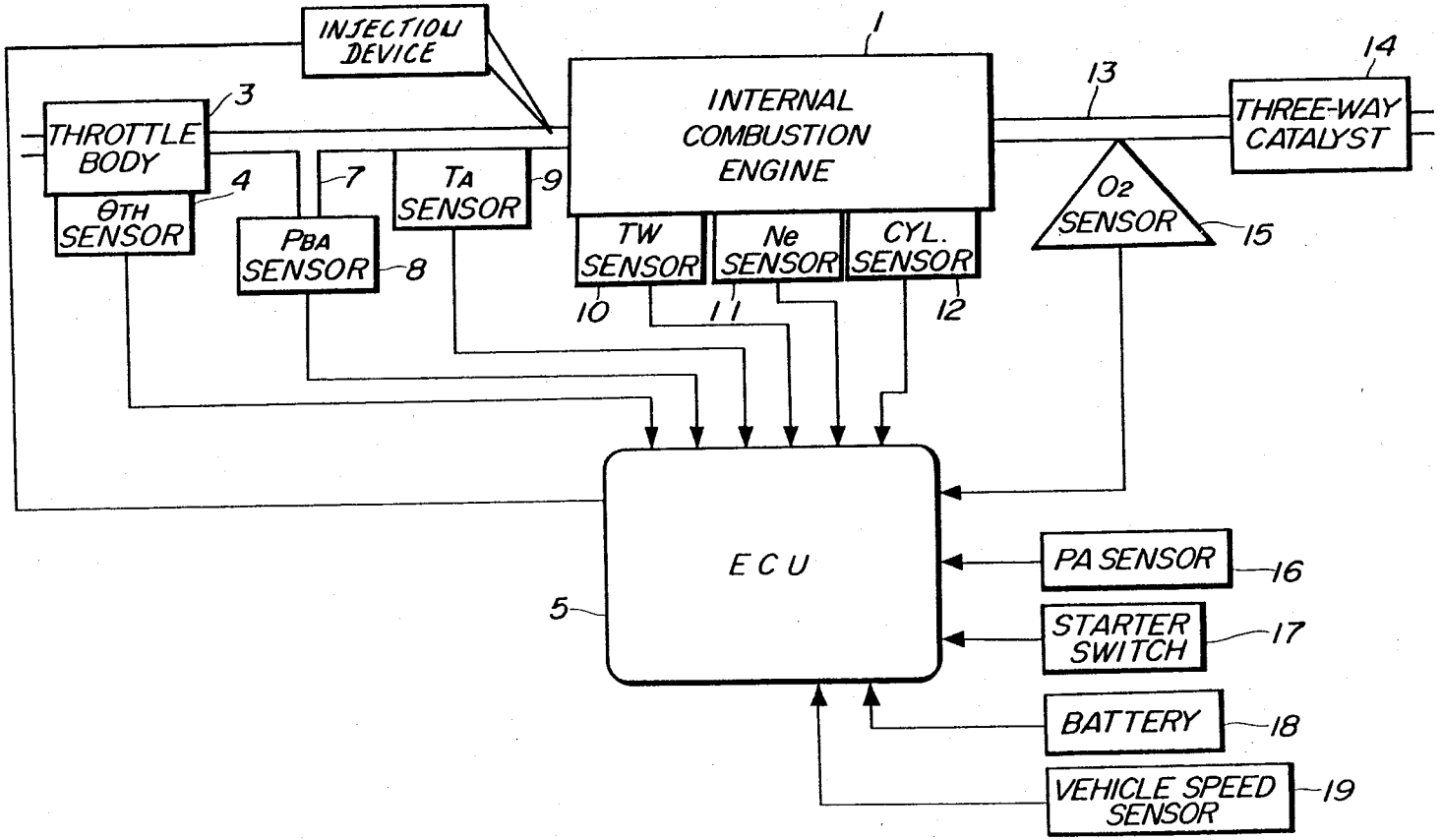
FIG. 1 is a block diagram illustrating the whole arrangement of a fuel supply control system to which is applied the method according to the present invention.

Referring first to FIG. 1, there is illustrated the whole arrangement of a fuel supply control system for internal combustion engines, to which the present invention is applied. Reference numeral 1 designates an internal combustion engine which is a multi-cylinder type having a plurality of cylinders 1*a*, for instance, four in number. This engine 1 has main combustion chambers which may be four in number and sub combustion chambers communicating with the main combustion chambers, none of which is shown. An intake pipe 2 is connected to the engine 1, which comprises a main intake pipe communicating with each main combustion chamber, and a sub intake pipe with each sub combustion chamber, respectively, neither of which is shown. Arranged across the intake pipe 2 is a throttle body 3 which accommodates a main throttle valve and a sub throttle valve mounted in the main intake pipe and the sub intake pipe, respectively, for synchronous operation. Neither of the two throttle valves is shown. A throttle valve opening (θTH) sensor 4 is connected to the main throttle valve for detecting its valve opening and converting same into an electrical signal which is supplied to an electronic control unit (hereinafter called "ECU") 5.

A fuel injection device 6 is arranged in the intake pipe 2 at a location between the engine 1 and the throttle body 3, which comprises main injectors and a subinjector, none of which is shown. The main injectors correspond in number to the engine cylinders and are each arranged in the main intake pipe at a location slightly upstream of an intake valve, not shown, of a corresponding engine cylinder, while the subinjector, which is single in number, is arranged in the sub intake pipe at a location slightly downstream of the sub throttle valve, for supplying fuel to all the engine cylinders. The main injectors and the subinjector are electrically connected to the ECU 5 in a manner having their valve opening periods or fuel injection quantities controlled by signals supplied from the ECU 5.

On the other hand, an absolute pressure (PB) sensor 8 communicates through a conduit 7 with the interior of the main intake pipe of the throttle body 3 at a location immediately downstream of the main throttle valve. The absolute pressure sensor 8 is adapted to detect absolute pressure in the intake pipe 2 and applies an electrical signal indicative of detected absolute pressure to the ECU 5. An intake-air temperature (TA) sensor 9 is arranged in the intake pipe 2 at a location downstream of the absolute pressure sensor 8 and also electrically connected to the ECU 5 for supplying thereto an electrical signal indicative of detected intake air temperature.

An engine temperature (TW) sensor 10, which may be formed of a thermistor or the like, is mounted on the main body of the engine 1 in a manner embedded in the peripheral wall of an engine cylinder having its interior filled with cooling water, an electrical output signal of which is supplied to the ECU 5.

An engine rpm sensor (hereinafter called "Ne sensor") 11 and a cylinder-discriminating sensor 12 are arranged in facing relation to a camshaft, not shown, of the engine 1 or a crankshaft of same, not shown. The former 11 is adapted to generate one pulse at a particular crank angle each time the engine crankshaft rotates through 180 degrees, i.e., upon generation of each pulse of the top-dead-center position (TDC) signal, while the latter is adapted to generate one pulse at a particular crank angle of a particular engine cylinder. The above pulses generated by the sensors 11, 12 are supplied to the ECU 5.

A three-way catalyst 14 is arranged in an exhaust pipe 13 extending from the main body of the engine 1 for purifying ingredients HC, CO and NOx contained in the exhaust gases. An $O_2$ sensor 15 is inserted in the exhaust pipe 13 at a location upstream of the three-way catalyst 14 for detecting the concentration of oxygen in the exhaust gases and supplying an electrical signal indicative of a detected oxygen concentration value to the ECU 5.

Further connected to the ECU 5 are a sensor 16 for detecting atmospheric pressure (PA), a starter switch 17 for actuating a starter, not shown, provided in the engine, and a battery 18 as a power source. An output signal from the sensor 16, a signal indicative of on and off positions of the starter switch 17 and an output voltage from the battery 18 are supplied to the ECU 5.

Next, the fuel quantity control operation of the electronic fuel supply control system arranged as above will now be described in detail.

Figure 2:
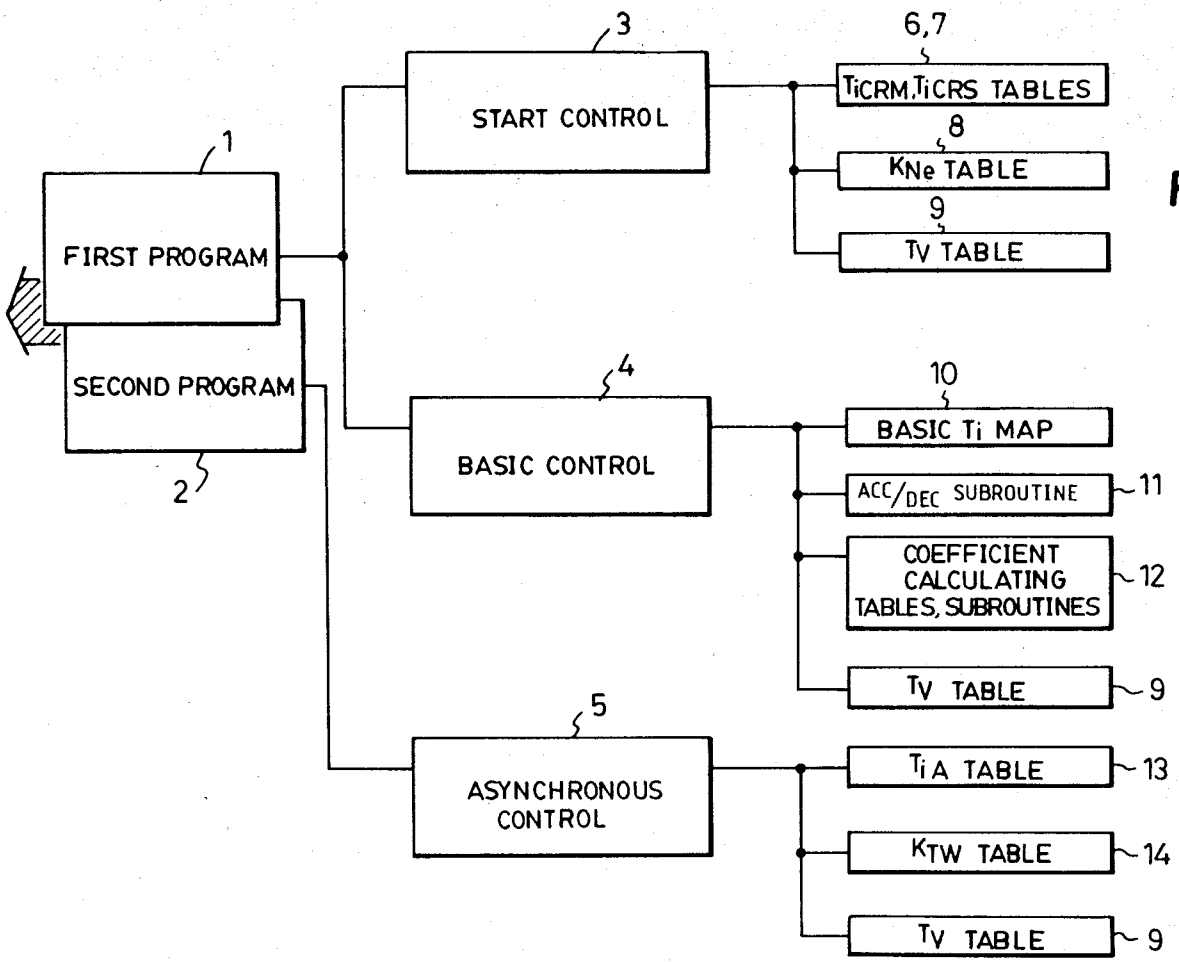
FIG. 2 is a block diagram illustrating a whole program for control of the valve opening periods TOUTM, TOUTS of the main injectors and the subinjector, which are operated by an electronic control unit (ECU) in FIG. 1.

Referring to FIG. 2, there is illustrated a block diagram showing a whole program for air/fuel ratio control, i.e. control of valve opening periods TOUTM, TOUTS of the main injectors and the subinjector, which is executed by the ECU 5. The program comprises a first program 1 and a second program 2. The first program 1 is used for fuel quantity control in synchronism with the TDC signal, and comprises a start control subroutine 3 and a basic control subroutine 4, while the second program 2 comprises an asynchronous control subroutine 5 which is carried out in asynchronism with or independently of the TDC signal.

In the start control subroutine 3, the valve opening periods TOUTM and TOUTS are determined by the following basic equations:

$$TOUTM = TiCRM \times KNe + (TV + \Delta TV) \quad (1)$$

$$TOUTS = TiCRS \times KNe + TV \quad (2)$$

where TiCRM, TiCRS represent basic values of the valve opening periods for the main injectors and the subinjector, respectively, which are determined from a TiCRM table 6 and a TiCRS table 7, respectively, KNe represents a correction coefficient applicable at the start of the engine, which is variable as a function of engine rpm Ne and determined from a KNe table 8, and TV represents a correction value for increasing and decreasing the valve opening period in response to changes in the output voltage of the battery, which is determined from a TV table 9. ΔTV is added to TV applicable to the main injectors as distinct from TV applicable to the subinjector, because the main injectors are structurally different from the subinjector and therefore have different operating characteristics.

The basic equations for determining the values of TOUTM and TOUTS applicable to the basic control subroutine 4 are as follows:

$$TOUTM = (TiM - TDEC) \times (KTA \times KTW \times KAFC \times KPA \times KAST \times KWOT \times KO_2 \times KLS) + TACC \times (KTA \times KTWT \times KAFC) + (TV + \Delta TV) \quad (3)$$

$$TOUTS = (Tis - TDEC) \times (KTA \times KTW \times KAST \times KPA) + TV \quad (4)$$

where TiM and TiS represent basic values of the valve opening periods for the main injectors and the subinjector, respectively, and have their values determined from a basic Ti map 10. The basic Ti map is stored in a memory within the ECU 5, for instance, in the form of a plurality of predetermined basic values of fuel quantity as functions of engine rpm Ne and intake pipe pressure (absolute pressure) PB. TDEC and TACC represent correction values applicable, respectively, at engine deceleration and at engine acceleration and have their values determined by acceleration and deceleration subroutines 11. KTA, KTW, etc. are correction coefficients and have their values determined by their respective tables and/or subroutines 12. KTA is an intake air temperature-dependent correction coefficient and has its value determined from a table as a function of actual intake air temperature, KTW a fuel increasing coefficient which has its value determined from a table as a function of actual engine cooling water temperature TW, KAFC a fuel increasing coefficient applicable after fuel cut operation, which has its value determined by a subroutine, KPA an atmospheric pressure-dependent correction coefficient, having its value determined from a table as a function of actual atmospheric pressure, and KAST a fuel increasing coefficient applicable after the start of the engine, having its value determined by a subroutine. KWOT is a coefficient for enriching the air/fuel mixture, which is applicable at wide-open-throttle and has a constant value, $KO_2$ an "oxygen concentration-responsive feedback control" correction coefficient, which has its value determined by a subroutine as a function of actual oxygen concentration in the exhaust gases, and KLS a mixture-leaning coefficient applicable at "lean stoich." operation and having a constant value. The term "stoich." is an abbreviation of a word "stoichiometric" and means a stoichiometric or theoretical air/fuel ratio of the mixture.

On the other hand, the valve opening period TMA for the main injectors which is applicable in asynchronism with the TDC signal is determined by the following equation:

$$TMA = TiA \times KTWT \times KAST + (TV + \Delta TV) \quad (5)$$

where TiA represents a TDC signal-asynchronous fuel increasing basic value applicable at engine acceleration and in asynchronism with the TDC signal. This TiA value is determined from a TiA table 13. KTWT is defined as a fuel increasing coefficient applicable at and after TDC signal-synchronous acceleration control as well as at TDC signal-asynchronous acceleration control, and has its value calculated from a value of the aforementioned water temperature-dependent fuel increasing coefficient KTW obtained from the table 14.

Figure 3:
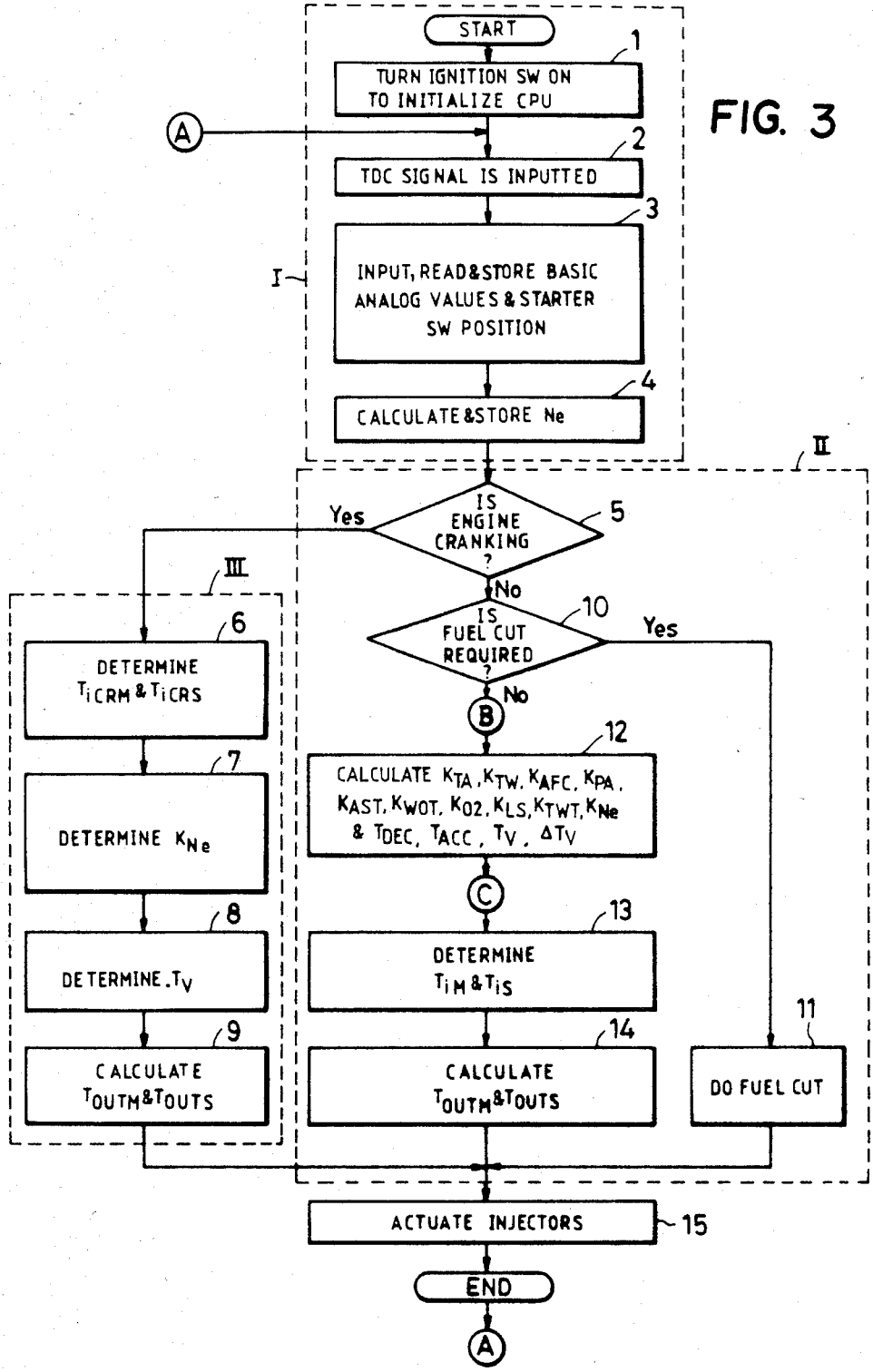
FIG. 3 is a flow chart showing a main program for control of the valve opening periods TOUTM, TOUTS.

Referring next to FIG. 3, there is shown a flow chart of the aforementioned first program 1 for control of the valve opening periods in synchronism with the TDC signal in the ECU 5. The whole program comprises an input signal processing block I, a basic control block II and a start control block III. First in the input signal processing block I, when the starter switch 17 in FIG. 1 is turned on, a CPU in the ECU 5 is initialized at the step 1 and the TDC signal is inputted to the ECU 5 as the engine starts at the step 2. Then, all basic analog values are inputted to the ECU 5, which include detected values of atmospheric pressure PA, absolute pressure PB, engine cooling water temperature TW, atmospheric air temperature TA, throttle valve opening θth, battery voltage V, output voltage value V of the $O_2$ sensor and on-off states of the starter switch 17 in FIG. 1, some necessary ones of which are then stored therein (step 3). Further, the period of time between a pulse of the TDC signal and the next pulse of same is counted to calculate actual engine rpm Ne on the basis of the counted value, and the calculated value is stored in the ECU 5 (step 4). The program then proceeds to the basic control block II. In this block, a determination is made, using the calculated Ne value, as to whether or not the engine rpm is smaller than the cranking rpm (starting rpm) at the step 5. If the answer is affirmative, the program proceeds to the start control subroutine in the start control block III. In this block, values of TiCRM and TiCRS are selected from a TiCRM table and a TiCRS table, respectively, on the basis of the detected value of engine cooling water temperature TW (step 6). Also, the value of Ne-dependent correction coefficient KNe is determined by using the KNe table (step 7). Further, the value of battery voltage-dependent correction value TV is determined by using the TV table (step 8). These determined values are applied to the aforementioned equations (1), (2) to calculate the values of TOUTM, TOUTS (step 9).

If the answer to the question of the above step 5 is no, it is determined whether or not the engine is in a condition for carrying out fuel cut, at the step 10. If the answer is yes, the values of TOUTM and TOUTS are both set to zero, at the step 11, as hereinafter described in detail.

On the other hand, if the answer to the question of the step 10 is negative, calculations are carried out of values of correction coefficients KTA, KTW, KAFC, KPA, KAST, KWOT, $KO_2$, KLS, KTWT, etc. and values of correction values TDEC, TACC, TV, and TV, by means of the respective calculation subroutines and tables, at the step 12. These correction coefficients and correction values have their values determined by respective subroutines and tables, and the encircled symbols B–C corresponds to the same symbols in these subroutines.

Then, basic valve opening period values TiM and TiS are selected from respective maps of the TiM value and the TiS value, which correspond to data of actual engine rpm Ne and actual absolute pressure PB, at the step 13.

Then, calculations are carried out of the values TOUTM, TOUTS on the basis of the values of correction coefficients and correction values selected at the steps 12 and 13, as described above, using the aforementioned equations (3), (4) (the step 14). The main injectors and the subinjector are actuated with valve opening periods corresponding to the values of TOUTM, TOUTS obtained by the aforementioned steps 9, 11 and 14 (the step 15).

Figures 4, 4A:
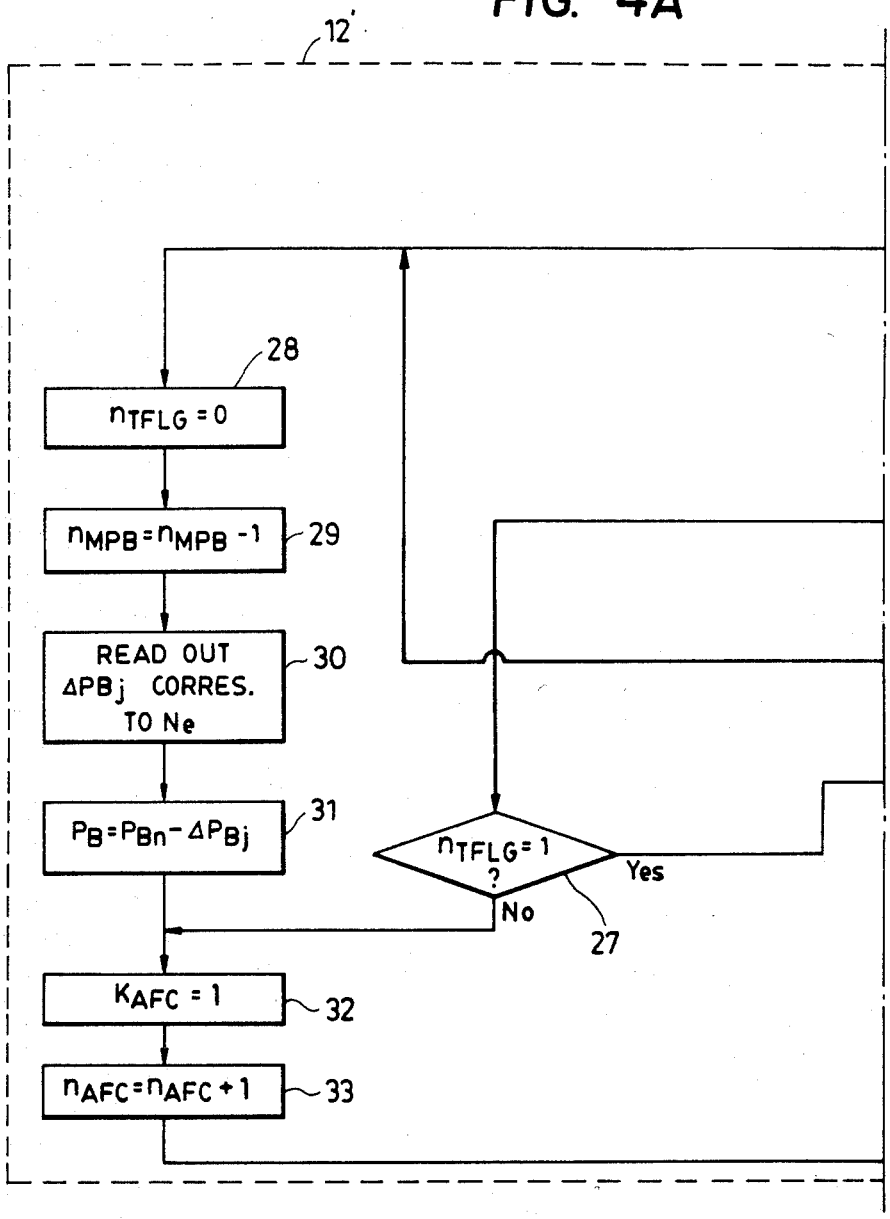
FIGS. 4*a* and 4*b* are a flow chart showing a subroutine for calculating the value of an after-fuel cut fuel increasing coefficient KAFC.
Figure 4B:
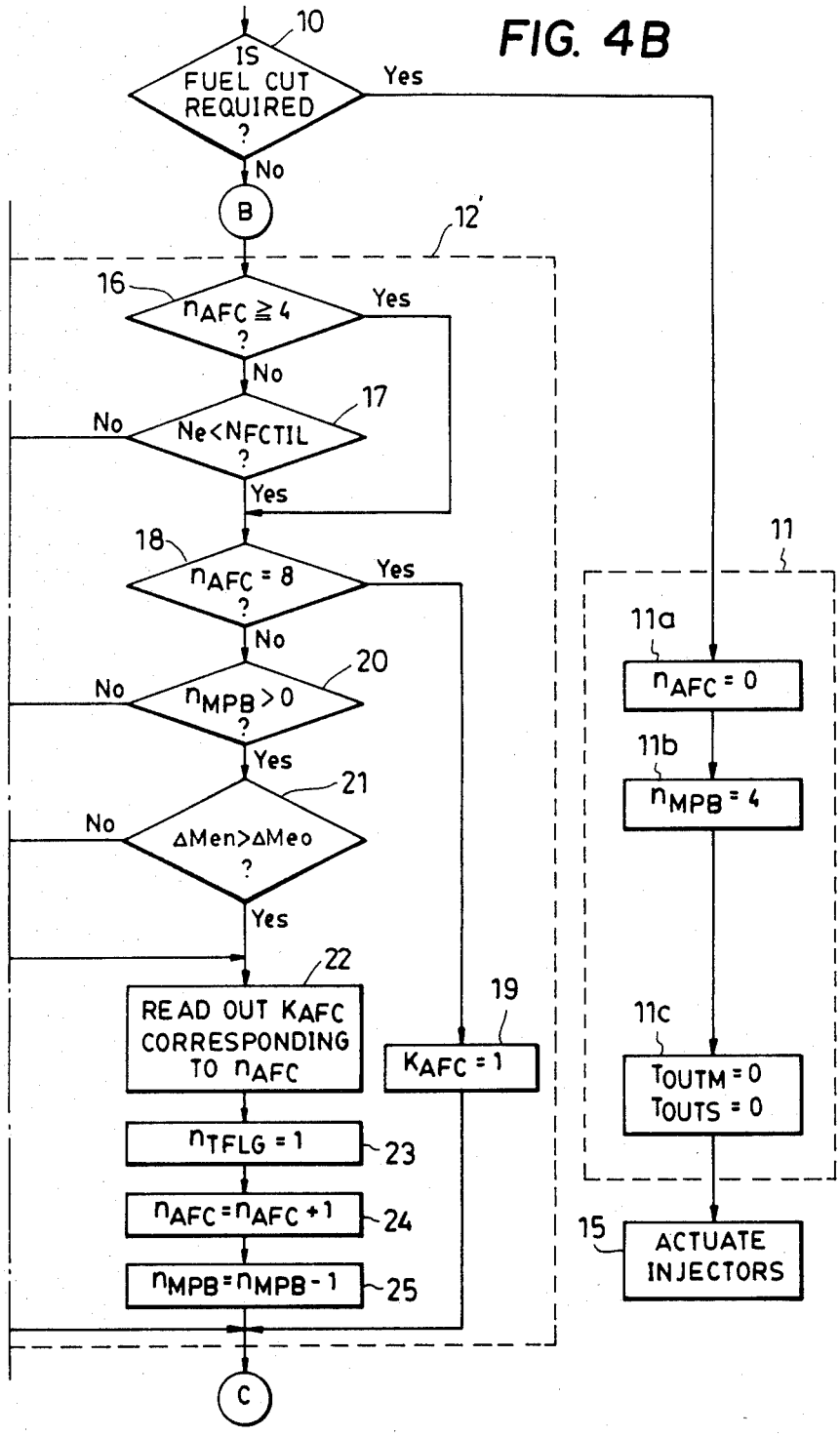

FIG. 4 shows a flow chart of a subroutine for calculating the value of the after-fuel cut fuel increasing coefficient KAF. First, as previously stated, in the step 10 in FIG. 3, whether or not the engine is in a fuel cut operating region is determined, and when the answer is yes, the program proceeds to the step 11 in FIG. 3, wherein the value of a control variable NAFC, hereinafter referred to, is reset to zero, at the sub-step 11*a*, and at the same time, the value of another control variable MPB, also referred to later, is set to a value corresponding to the number of the engine cylinders, for instance, 4 in the case of a four-cylinder engine, at the sub-step 11*b*. This control variable MPB is employed by the following reason: As previously stated, the actual intake air quantity of the engine during normal combustion operation engine is larger than that during motoring, so long as the engine speed remains constant. This means that the intake pipe absolute pressure of the engine during motoring is higher than that during normal combustion operation so long as the intake air quantity remains constant. Therefore, if during motoring of the engine the fuel supply quantity is calculated on the basis of a detected value of intake pipe absolute pressure in the same manner as that employed for calculation of the fuel supply quantity during normal combustion operation of the engine, the air/fuel ratio of the mixture supplied to the engine becomes overrich during motoring, if the intake pipe absolute pressure is the same between during motoring and during normal combustion operation. To avoid this disadvantage, the quantity of fuel being supplied to the engine should be reduced after a fuel cut operation has been terminated and before the engine completely gets out of the motoring state to reach a normal combustion operating state. As a practical measure, a first batch of fuel injection quantity supplied into each of the cylinders after the termination of a fuel cut operation should be reduced before four pulses of the TDC signal are generated after the termination of the fuel cut operation, when the absolute pressure sensor can detect a normal value of the intake pipe absolute pressure PB as prevailing during a normal combustion operation of the engine. To effect such reduction in the fuel supply quantity, according to the invention, the nominal value of the intake pipe absolute pressure PB is intentionally changed so as to reduce the fuel supply quantity, as hereinafter described in detail. In order to determine the timing of nominal change of the intake pipe absolute pressure PB, the value of the above control variable NMPB is set to 4. Further, when the answer to the step 10 in FIG. 3 is yes, the values of the valve opening periods TOUTM, TOUTS for the injectors are both set to zero, at the sub-step 11*c* to render the main injectors and the subinjector inoperative, at the step 15 in FIG. 3.

Figure 5:
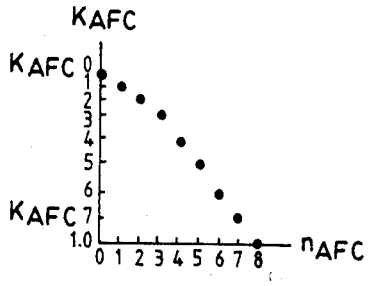
FIG. 5 is a view showing a table of the relationship between the value of the after-fuel cut fuel increasing coefficient KAFC and the value of a control variable NAFC.

On the other hand, if in the step 10 it is determined that conditions for effecting the fuel cut are not satisfied, that is, the answer is negative, a subroutine 12' is executed for calculating the value of the after-fuel cut fuel increasng coefficient KAFC, which is one of the subroutines 12 for determining the values of correction coefficients and correction values, appearing in FIG. 3. In the subroutine 12', it is determined at the step 16 whether or not the value of the aforementioned control variable NAFC representing a count of the number of pulses of the TDC signal inputted to the ECU 5 after the termination of a fuel cut operation has exceeded the number of engine cylinders, for instance 4. If the answer to the question of the step 16 is no, it is then determined at the step 17 whether or not the engine rpm Ne is smaller than predetermined rpm NFCTIL. If the answer is yes, that is, if the engine rpm is smaller than the predetermined rpm NFCTIL, whether or not the count or value of the control variable NAFC has reached a predetermined number, for instances, 8, is determined at the step 18, followed by a determination as to whether or not the other control variable NMPB is larger than zero, at the step 20. When the control variable NMPB is larger than zero, it means that all the cylinders are not yet eah supplied with a first batch of fuel after termination of the fuel cut operation. If the determination at the step 20 provides an affirmative answer, it is determined at the following step 21 whether or not the magnitude of a varition or change in the engine rotational speed is larger than a predetermined value. More specifically, it is determined whether or not the magnitude ΔMen of a variation or change in the time interval Me between adjacent pulses of the TDC signal, which is determined upon generation of each pulse of the TDC signal, is larger than a predetermined value ΔMeO. A value of the time interval Me determined upon generation of a present pulse of the TDC signal represents the time interval between the same present pulse of the TDC signal and the preceding pulse of the TDC signal. The time interval Me therefore has a value proportional to the reciprocal of the engine rpm Ne. The value ΔMen indicative of the magnitude of a variation in the time interval Me is determined as a difference between such time intervals, obtained by subtractng a time interval Men−1 determined upon generation of the preceding pulse of the TDC signal from a time interval Men determined upon generation of the present pulse of the TDC signal (ΔMen=Men−Men−1). If the value ΔMen is larger than the predetermined value ΔMeO, it means that the rotational speed of the engine is rapidly decreasing. Since there can occur engine stall when the engine rotational speed is rapidly decreasing immediately after the termination of a fuel cut operation, increase of the quantity of fuel being supplied to the engine is then effected. That is, if the answer to the question at the step 21 is yes, a value of the after-fuel cut coefficient KAFC corresponding to the value of the control variable NAFC is read from a table of the coefficient KAFC, at the step 22. The above table is arranged as shown in FIG. 5, wherein a value of the coefficient KAFC corresponding to a value of zero of the control variable NAFC, that is, the initial value KAFCO is set at the maximum value (larger than 1). Each time a pulse of the TDC signal is generated after the termination of a fuel cut operation, the value of the control variable NAFC is increased by 1, and as is learned from the table, as the value of the control variable NAFC increases, the value of the coefficient KAFC decreases correspondingly. When the value of the control variable NAFC reaches a predetermined number of 8, the value of the coefficient KAFC becomes 1. The value of the coefficient KAFC read from the table is applied to the aforementioned equations (3), (4) and (5) to calculate the increment for increasing the fuel quantity being supplied to the engine. Then, the value of a flag signal NTFLG is set to 1 at the step 23 to indicate the setting of the value of the correction coefficient KAFC at the step 22. At the step 24, 1 is added to the value of the control variable NAFC, as a count of the number of execution of the present subroutine, and at the same time, 1 is subtracted from the value of the other control variable NMPB, at the step 25.

The above subroutine is repreatedly executed, and when the value of the control variable NAFC increases over 4, the answer to the question of the aforementioned step 16 becomes affirmative, and then the program immediately proceeds to the steps 18 and 20 to effect the respective determinations, without executing the determination of the step 17.

When the answer to the question of the step 20 is negative, that is, when the step 22 is executed four times, so that the subtraction at the step 25 brings about a result of NMPB=0, indicating that all the engine cylinders have each been supplied with a first batch of injected fuel after the termination of a fuel cut operation, the programs proceeds directly to the step 27 to determine whether or not the value of the flag signal NFLG is 1, while skipping the determination of the step 21, as to the magnitude of a variation in the engine rotational speed. Whether or not the step 22 is to be executed depends solely upon the results of the determination of the step 27. That is, when the answer to the question of the step 27 is affirmative, the program proceeds to the step 22, wherein a value of the coefficient KAFC corresponding to a value of the control variable NAFC is read from the table to continue the fuel increasing operation, whereas if the answer to the step 27 is negative, the program proceeds to the step 32, hereinafter referred to. If the answer to the question of the step 18 is affirmative, the value of the after-fuel cut fuel increasing coefficient KAFC is set to 1 to terminate the fuel increasing operation, at the step 19, followed by terminating the execution of the present subroutine.

If the results of the determination of the step 21 is negative, that is, when the magnitude of a variation in the engine rotational speed is smaller than the predetermined value, the steps 28–33 are executed, as hereinafter described, because on such occasion, there is no fear of occurrence of engine stall, even if the engine speed Ne is smaller than the predetermined rpm NFCTIL, and it is therefore unnecessary to increase the fuel quantity after the termination of a fuel cut operation.

If the answer to the question of the step 17 is negative, that is, when the engine rotational speed Ne is larger than the predetermined rpm NFCTIL, the step 28 et seq. are executed, because there is no possibility of occurrence of engine stall, even if the clutch of the engine is disengaged immediately after the termination of a fuel cut operation, or even if the transmission gear of the engine is shifted to its neutral position on such occasion, thus making it unnecessary to carry out the fuel increasing operation. First, in the step 28, the value of the flag signal NTFLG is set to zero, and then, in the step 29, the value of the control variable NMPB (=4) is reduced by 1. Then, a value of the difference ΔPBj between the intake pipe absolute pressure during motoring of the engine and that during normal combustion operation of the engine, which corresponds to the engine rotational speed Ne, is read from a table of ΔPBj values, shown in FIG. 6 and hereinafter referred to, at the step 30. This pressure difference value ΔPBj is subtracted from an actual detected value PBn of the intake pipe absolute pressure which is detected immediately after generation of a present pulse of the TDC signal, at the step 31, thus nominally changing the intake pipe absolute pressure PB. This nominally changed intake pipe absolute pressure PB is then used for reading a basic value of the fuel supply quantity from the basic Ti map 10 shown in FIG. 2, as a function of the engine rotational speed Ne. The nominal change of the intake pipe absolute pressure PB is continuously carried out until the value of the control variable NMPB is reduced to 0, that is, until all the engine cylinders are each supplied with a first batch of injected fuel after the termination of a fuel cut operation.

Figure 6:
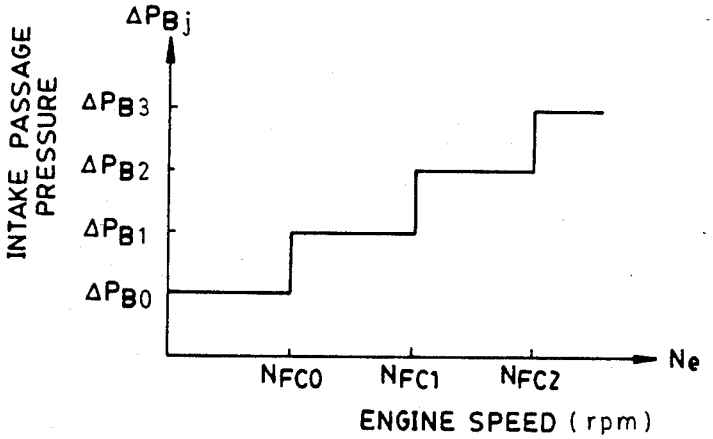
FIG. 6 is a view showing a table of the relationship between engine rpm Ne and a pressure difference value ΔPBj for nominally changing the intake pipe absolute pressure PBA.

Preferably, the above pressure difference value ΔPBj is set to larger values as the engine rotational speed increases. FIG. 6 shows a table of the relationship between the engine rotational speed Ne and the pressure difference value ΔPBj, wherein, by way of example, there are provided the three aforementioned predetermined engine rpm values $NFC_0$, $NFC_1$ and $NFC_2$ having four corresponding pressure difference values $\Delta PB_0$ (32 mmHg), $\Delta PB_1$ (52 mmHg), $\Delta PB_2$ (64 mmHg), and $\Delta PB_3$ (70 mmHg).

Figure 7:
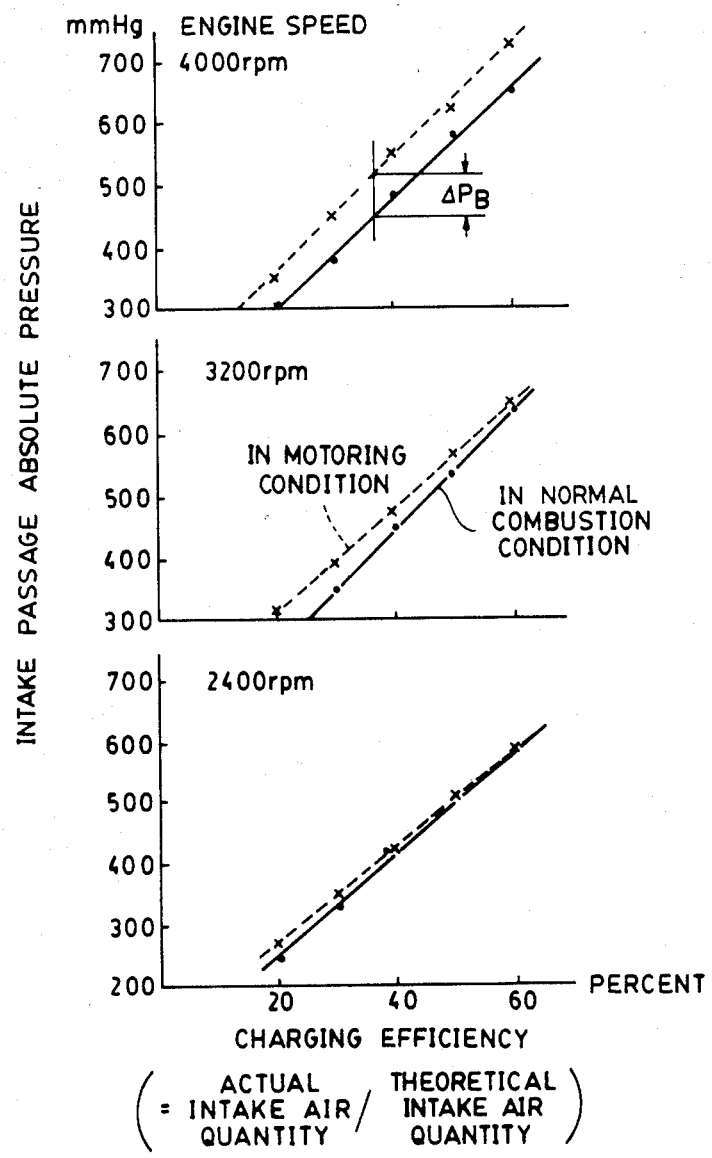
FIG. 7 is graph showing the relationship between values of intake passage absolute pressure occurring during motoring of the engine and during normal combustion operation of the engine and the charging efficiency of the engine.

In this way, the pressure difference value ΔPBj is set to larger values corresponding to increases in the engine rotational speed for the following reasons: FIG. 7 shows test results showing differences in value between intake passage absolute pressure cccurring at engine operation in fuel cut effecting motoring condition and that occurring at engine operation in normal combustion condition. As shown by the test results in FIG. 7, so far as the intake passage absolute pressure remains constant, the charging efficiency of the engine at normal combustion operation (shown by the solid lines in FIG. 7) is higher than that at motoring (shown by the broken lines in FIG. 7), that is, the actual intake air quantity being supplied to the engine in normal combustion operating condition is larger than that at motoring operation, as is already known. Conversely, the intake passage absolute pressure at motoring of the engine is larger than that at normal combustion operation, so long as the same quantity of intake air is supplied to the engine. As the difference ΔPBj increases along with an increase in the engine rotational speed, as illustrated by the test results in FIG. 7, the pressure difference value ΔPBj for nominally changing the intake pipe absolute pressure PB at fuel cut termination has also to be set so as to increase along with an increase in the engine rotational speed.

Reverting now to FIG. 4, at the step 32, the value of the fuel increasing coefficient KAFC is set to 1, and simultaneously 1 is added to the value of the control variable NAFC, at the step 33.

When the consecutive steps 28 through 33 are repeatedly executed four times, the values of the control variables NAFC and NMPB become 4 and 0, respectively, and thereafter, the aforementioned steps 16, 18, 20 and 27 are executed in the mentioned order. In the step 27, the determination provides a negative answer, since in the step 28, the value of the flag signal NFLG is set to zero, so that the steps 32 and 33 are then executed. After all the engine cylinders have each been supplied with a first batch of injected fuel after termination of the fuel cut operation, the nominal change of the intake pipe absolute pressure PB is no longer necessary, and accordingly, the steps 30 and 31 are not executed.

What is claimed is:

1. A method for controlling the quantity of fuel being supplied to an internal combustion engine, to a required quantity, by increasing the fuel quantity by an increment which is set in synchronism with generation of pulses of a predetermined control signal generated at a predetermined crank angle of said engine, after termination of a fuel cut operation which is effected when said engine is operating in a predetermined operating condition while it is decelerating, the method comprising the steps of: (1) detecting a transition of the operative state of said engine from said predetermined operating condition wherein the fuel supply to said engine is to be cut off to another operating condition wherein the fuel supply is to be effected; (2) detecting the magnitude of a variation in the rotational speed of said engine and determining whether or not said detected magnitude of variation is larger than a predetermined value; and (3) effecting said increase of the fuel quantity for a period of time after said transition has been detected and before a predetermined number of pulses of said predetermined control signal are generated, so long as it is determined in said step (2) that said detected magnitude of variation is larger than said predetermined value.

2. A method as claimed in claim 1, wherein said increase of the fuel quantity is effected only when the rotational speed of said engine is lower than a predetermined value of rpm.

3. A method for controlling the quantity of fuel being supplied to an internal combustion engine having a plurality of cylinders, an intake passage, and a pressure sensor means for detecting pressure in said intake passage, to a required quantity, by increasing a quantity of fuel which is set at least in dependence upon the value of an output signal from said pressure sensor means, by an increment which is set in synchronism with generation of pulses of a predetermined control signal generated at a predetermined crank angle of said engine, after the termination of a fuel cut operation which is effected when said engine is operating in a predetermined operating condition while it is decelerating, the method comprising the steps of: (1) detecting a transition of the operative state of said engine from said predetermined operating condition wherein the fuel supply to said engine is to be cut off to another operating condition wherein the fuel supply is to be effected; (2) detecting the magnitude of a variation in the rotational speed of said engine and determining whether or not said detected magnitude of variation is larger than a predetermined value; and (3) controlling the quantity of fuel being supplied to said engine in the following manner, for a period of time after said transition has been detected and before a predetermined number of pulses of said predetermined control signal are generated: (a) effecting said increase of the fuel quantity so long as it is determined in said step (2) that said detected magnitude of variation is larger than said predetermined value; and (b) subtracting a predetermined value of pressure in said intake passage, from an actual detected value of pressure in said intake passage detected by said pressure sensor means and determining the quantity of fuel being supplied to said engine in dependence on the value of pressure in said intake passage thus subtracted, for a period of time after said transition has been detected and before all said cylinders of said engine are supplied with fuel, so long as it is determined in said step (2) that said detected magnitude of variation is smaller than said predetermined value.

4. A method as claimed in claim 3, wherein said increase of the fuel quantity is effected only when the rotational speed of said engine is lower than a predetermined value of rpm.

5. A method as claimed in claim 3, wherein said predetermined value of pressure in said intake passage to be subtracted from an actual value of pressure in said intake passage detected by said pressure sensor means is set to a value corresponding to the difference between a value of pressure in said intake passage detected during non-combustion operation of said engine and one detected during normal combustion operation of said engine, provided that the rotational speed of said engine remains constant between said non-combustion operation of said engine and said normal combustion operation thereof.

6. A method as claimed in claim 5, wherein said predetermined value of pressure in said intake passage is set to larger values as the rotational speed of said engine becomes higher.

* * * * *